United States Patent [19]

Bathrick et al.

[11] Patent Number: 5,063,623

[45] Date of Patent: Nov. 12, 1991

[54] POWER MODULE FOR AN ARTICULATED BED

[76] Inventors: Leeland M. Bathrick, 6820 New Hampshire Trail, Crystal Lake, Ill. 60014; Michael W. Chizck, 1521 Walter Ave., Racine, Wis. 53403; Glenn Brittain, 2613 Drucker La., McHenry, Ill. 60060

[21] Appl. No.: 597,525

[22] Filed: Oct. 15, 1990

[51] Int. Cl.[5] ..... A61G 7/05

[52] U.S. Cl. ..... 5/67; 5/68; 5/63

[58] Field of Search ..... 5/66–69, 5/63

[56] References Cited

U.S. PATENT DOCUMENTS

| | | | |
|---|---|---|---|
| 3,073,635 | 1/1963 | Schafer | 5/63 |
| 3,245,092 | 4/1966 | Kreuz | 5/68 |
| 3,300,794 | 6/1967 | Altorfer | 5/68 |
| 3,921,230 | 11/1975 | Hanning | 5/68 |
| 4,005,497 | 2/1977 | Sutter | 5/68 |
| 4,094,024 | 6/1978 | Benoit | 5/68 |
| 4,120,057 | 10/1978 | Neumann | 5/68 |
| 4,271,545 | 6/1981 | Christian | 5/68 |
| 4,463,463 | 8/1984 | Kaneko | 5/68 |

FOREIGN PATENT DOCUMENTS

| | | | |
|---|---|---|---|
| 667395 | 3/1962 | Canada | 5/67 |

*Primary Examiner*—Michael F. Trettel
*Assistant Examiner*—Flemming Saether

[57] ABSTRACT

A power module for an articulated bed planar mattress support sized to easily fit into a standard bed frame. The mattress support has planar panels hinged to one another with a stationary central panel. The power module has an elongated housing fixed to the bottom of the central stationary panel. The housing carries two separte motors that reversely drive transverse rocker shafts mounted and solely supported in the ends of the housing. The distal ends of the rocker shafts carry rocker arms that have end rollers that engage and swing the mattress panels up and down.

13 Claims, 6 Drawing Sheets

POWER MODULE FOR AN ARTICULATED BED

BACKGROUND OF THE INVENTION

Articulated beds or bed frames for the home market have not heretofore achieved significant commercial success and such beds have been marketed for the most part as a hospital or nursing home product and with such objectives have been over designed and overly complicated and as a result have been too costly for the residential or home market for articulated beds.

Over the last several decades articulated chairs and sofas have achieved some commercial success in the residential market but only recently has such technology been adapted for the residential articulated bed marketplace.

A primary consideration in the design of articulated beds and components therefore in the residential market is ease of shipment because a container the size of an entire complete articulated bed assembly would not only be excessively large but too heavy for a single delivery person to bring into the home to install.

One attempt at solving this problem is illustrated in the Elliott U.S. Pat. No. 4,381,571 which shows an articulated mattress spring that is adapted to fit on top of and rest on a separate simple rectangular bed frame. The Elliott power drive module or mattress frame includes large stationary "L" shaped side sections with cross members to provide support for axial oriented motor and screw assemblies that drive complicated four bar linkages at the four corners of the module that serve to raise and lower the head and leg sections of the mattress support. While Elliott suggests that these parts, numbering literally hundreds, may be disassembled for shipment it is realistically not practical to have the purchaser reassemble this complex device in his or her home.

A similar articulated bed is illustrated in the Neumann U.S. Pat. No. 4,120,057 and it shows a power system for an articulated mattress support and, like the Elliott design, is adapted to fit into a bed frame. The problem with the Neumann device is that it requires a large rectangular frame the size of the bed frame itself so that no size reduction is practically possible in the Neumann system.

Furthermore in the Elliott device the power module with drive motors, gearing and rocker shafts, requires that the rocker shafts be mounted in outboard bearings, i.e. bearings in the large rectangular frame described above and such outboard bearings denigrate the capability of shipping the power module in easily carried containers without requiring any significant reassembly at the purchaser's location.

Other articulated beds are illustrated in the Muir U.S. Pat. No. 1,397,773 and the Szemplak, et al. U.S. Pat. No. 3,051,965. The patent to Muir also shows a device for adjusting the articulated bed. Double motor-type systems are shown in the Taylor U.S. Pat. No. 2,500,742. Another standard articulated bed frame is illustrated in Hanning, et al. U.S. Pat. No. 3,921,230.

It is the primary object of the present invention to provide a power module for an articulate bed assembly that ameliorates the problems noted above in prior articulated bed designs.

SUMMARY OF THE PRESENT INVENTION

In accordance with the present invention a power module is provided for an articulated bed assembly designed to easily fit into a standard bed frame, and is designed to be easily transported without disassembly to a bed manufacturing location or to a residential purchaser.

Toward these ends, a mattress support is provided that has wooden planar panels hinged to one another with a stationary central section, a pivotal head section and a pivotally interconnected thigh and foot sections. The power module has an elongated housing that supports separate electric drive motors, one for the head section and one for the thigh and foot sections, the drive gearing that transmits power from the motors to transversely mounted rocker shafts that have rocker arms at the ends thereof that respectively pivot the head and leg sections upwardly and downwardly with a suitable control that reversely drives the two motors.

An important aspect of the present invention is the housing for the drive module provides the sole pivotal support for these two rocker shafts. As noted above these rocker shafts have previously been journalled inside frame members that require the drive module and the side frame members to be shipped as a unit from manufacturing location to assembly location or from assembly to ultimate purchaser, because frequently the receiving party cannot technically provide the proper assembly. By pivotally mounting these rocker arms in the housing assembly as opposed to outboard bearings a significant amount of assembly is reduced and the power module can be shipped in a much smaller container in its completely assembled form.

Another advantage in this power module is that it can be removed as a unit from the mattress support for repair or replacement. Furthermore, the module construction can be made part of an inner spring envelope.

This unitary power module, i.e. the elongated housing containing the two drive motors, the two rocker shafts, the rocker arms and interconnecting gearing, offers the manufacture a variety of market options without requiring disassembly of the power module. One option is the power module manufacturer can ship the power module fully assembled to the articulated bed manufacturer, frequently skilled in wood working and to a limited extent welding, but not skilled in power drive systems. Such bed manufacturers would construct the wooden planar mattress support and simply attach the power module underneath the wooden mattress support panels. No other interconnections would be required to complete the power module and planar mattress support assembly in operative cooperation. The articulated bed manufacturer then may either sell this completed assembly as a unit that may be simply dropped into a standard bed frame by the retail purchaser or may complete the mattress support assembly by providing its own floor engaging frame so it can be sold as a completed unit.

Alternatively, the power module can have a single rocker shaft if only one of the back lift or leg lift is desired.

Other objects and advantages of the present invention will appear more clearly from the following detailed description.

DETAILED DESCRIPTION OF THE PREFERRED EMBODIMENTS

Figure 1:
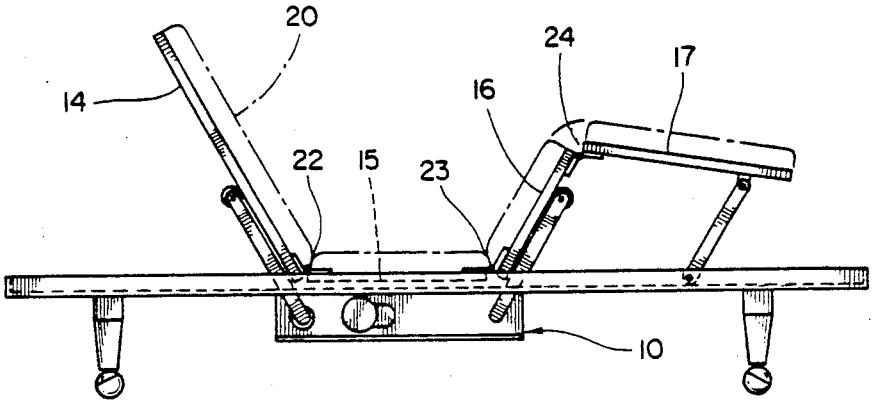
FIG. 1 is a right side view of the present power module shown attached to a planar mattress support inserted into a standard bed frame.

Referring to the drawings and particularly FIGS. 1 to 4, a power module 10 according to the present invention is shown attached to a central section of a mattress support assembly 12 that includes hingedly interconnected wood panels including back panel 14, central stationary panel 15, thigh panel 16 and foot panel 17.

The mattress support assembly 12 is adapted to provide the lower support for a mattress 20 that typically would be somewhat thinner and more flexible than a conventional mattress to accommodate the articulation of the mattress support assembly 12. In fact, the mattress 20 could itself include hinge elements along lines 22, 23 and 24 although the mattress itself forms no part of the present invention.

The mattress support assembly 12, along with the power module assembly 10, is adapted to drop into and fit within side rails 26 and 27 of a standard mattress frame 28. As is well known, side rails 26 and 27 conventionally are formed from angle iron include a horizontal portion 30 and a vertical portion 31. The mattress support panels 14, 15, 16 and 17 have a width slightly less than the inside width of the vertical frame member portion 31 and rest on the horizontal frame member portions 30. The foot panel 17 carries links 33 that are pivotally connected at 34 to the side rails 26 and 27 of the bed frame 28.

The panels 14, 15, 16 and 17 of the mattress support assembly 12 are preferably formed of plywood or other suitable composite board both because of their low cost and because furniture manufactures are skilled in handling such materials. Back panel 14 is pivotally hinged to central panel 15 (which is stationary in frame 28) by hinges 36, leg panel 16 is pivotally hinged to central panel 15 by hinges 37 and foot panel 17 is pivotally hinged to leg or thigh panel 16 by hinges 39.

Figure 2:
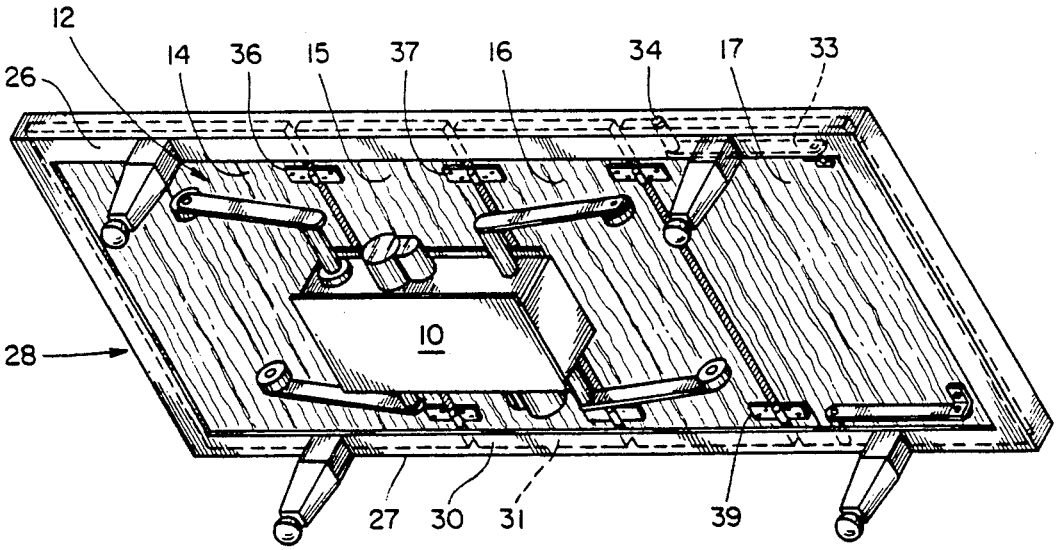
FIG. 2 is a lower perspective view of the power module, mattress support and standard bed frame, illustrated in FIG. 1.
Figure 3:
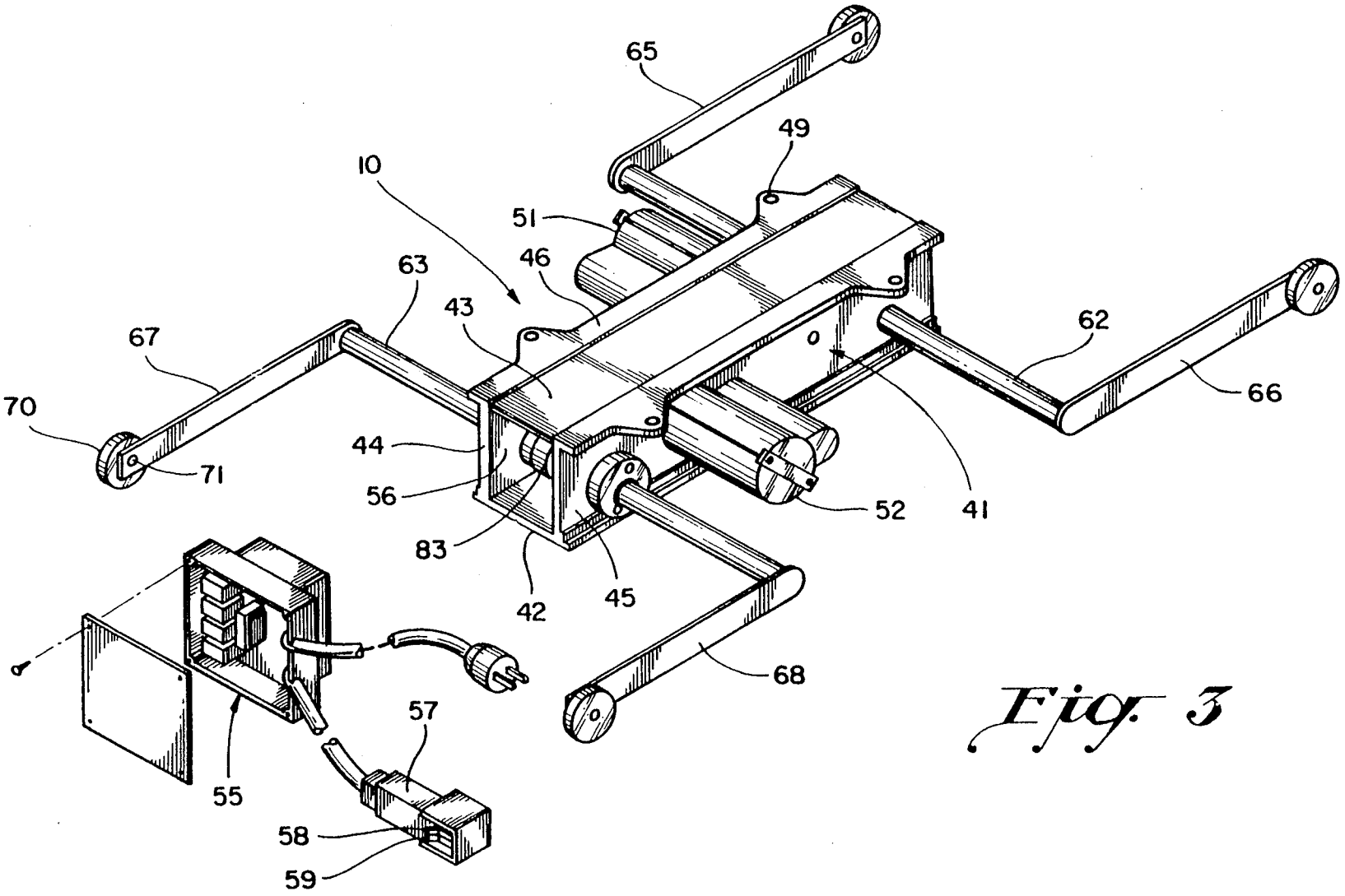
FIG. 3 is an enlarged perspective view of the power module illustrated in FIGS. 1 and 2.
Figure 4:
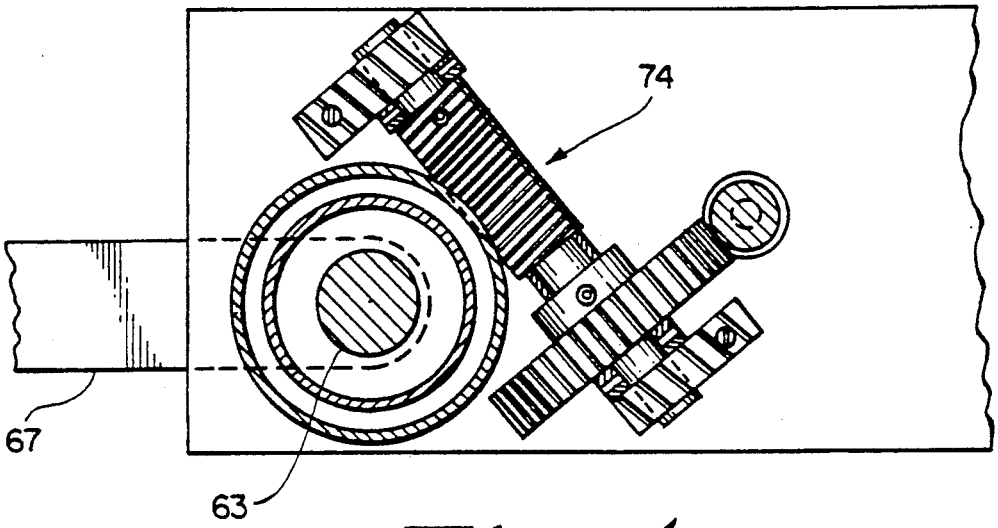
FIG. 4 is a right side view of the gearing on one of the rocker shafts in the power module shown in FIGS. 1 to 3.
Figure 5:
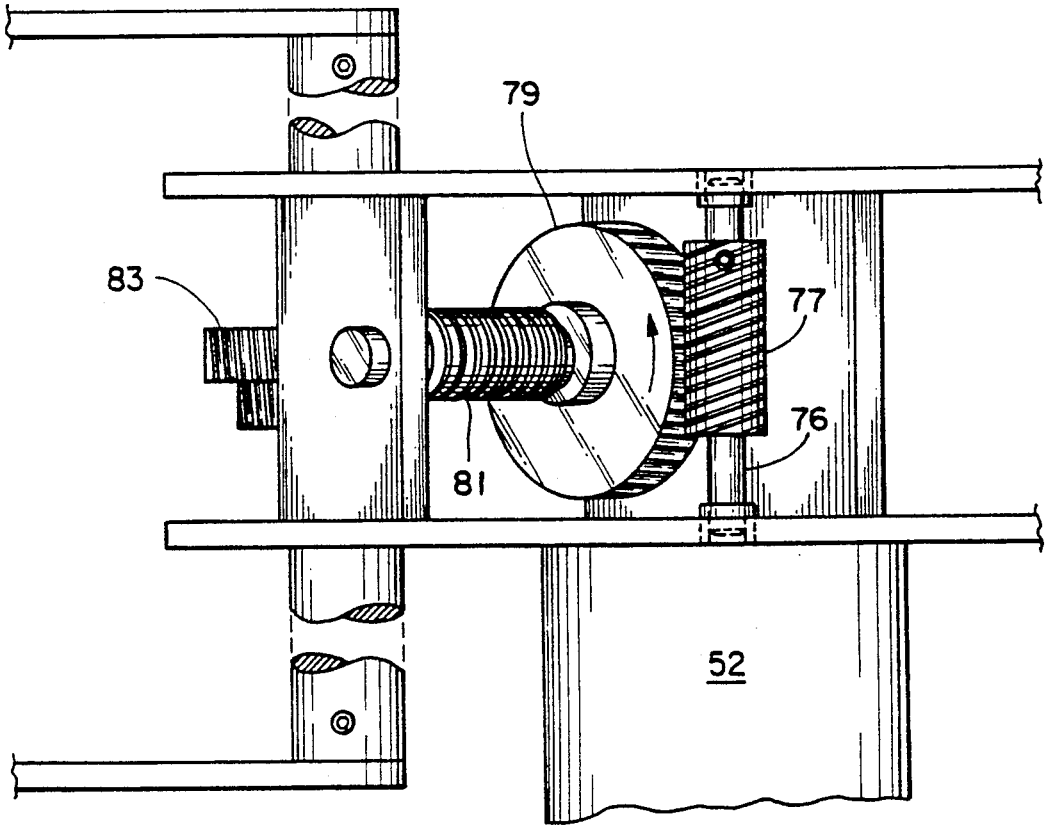
FIG. 5 is a top view of the gearing and rocker shaft illustrated in FIG. 3.

The power module 10 is more clearly illustrated in FIGS. 3, 4 and 5, and as seen in FIG. 3 the power module 10 includes an elongated rectangular housing having a bottom wall 42 a top wall 43 and side walls 44 and 45. These walls are formed from aluminum extrusions. The top wall 43 has flanges 46 and 47 that carry a plurality of bosses 49 that receive fasteners to connect the housing and the entire power module 10 to the lower surface of the central stationary seat panel 15 as illustrated in FIG. 2.

The side walls 44 and 45 support outwardly projecting electric motors assemblies 51 and 52 which power respectively the leg panel 16 and the head panel 14 in the mattress support 12. Motors 51 and 52 are controlled by a control system 55 that closes a forward opening 56 in the housing and has a remote switch assembly 57 that has separate switches 58 and 59 for reversely controlling the motors 51 and 52.

Motor 51 drives rear rocker shaft 62 while motor 52 drives forward rocker shaft 63. The rocker shafts 62 and 63 have rocker arms 65, 66, 67 and 68 connected at their outboard ends, each of which has a nylon roller 70, constructed for example of "Delrin" carried by a short axial shaft 71.

Each of the motors 51 and 52 drives its associated rocker shaft 62, 63 in oscillating motion through reducing worm and worm wheel gearing assembly 74 illustrated in FIGS. 4 and 5 which is identical for both motors although gearing 74 is illustrated in these FIGS. in connection with the forward rocker shaft 63.

As seen in FIG. 5 motor output shaft 76 carries a worm gear 77 that interengages with a worm wheel 79 that is shafted with another worm gear 81 that interengages with a worm wheel 83 fixed to rocker shaft 63. This double reduction gearing provides a gearing 74 with high reduction characteristics on the order of a 3600 to 1 RPM reduction between motor output shaft 76 and rocker shaft 63, bearing in mind that rocker shaft 63 oscillates less than a quarter of a revolution in moving head planar member 14 from its horizontal position to its fully upright position illustrated approximately in FIG. 1, and similar parameters are utilized for the rear or leg rocker shaft 62.

An important aspect of the present invention is that the rocker shafts 62 and 63 are rotatably supported in bearings carried by housing side walls 44, 45 and no other outboard means of support are provided for these rocker shafts 62 and 63. Thus, the power module 10 may be shipped as a unit to either the bed manufacturer or to the ultimate user without requiring any assembly to an outer frame commonly thought necessary in the prior art.

Figure 6:
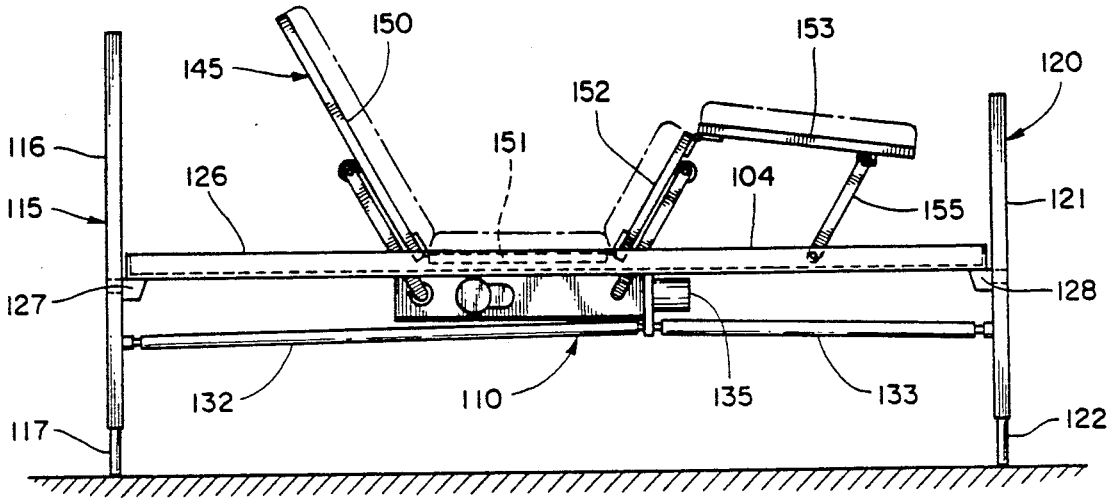
FIG. 6 is a right side view of a hospital type bed incorporating a modified form of the present power module assembly.
Figure 7:
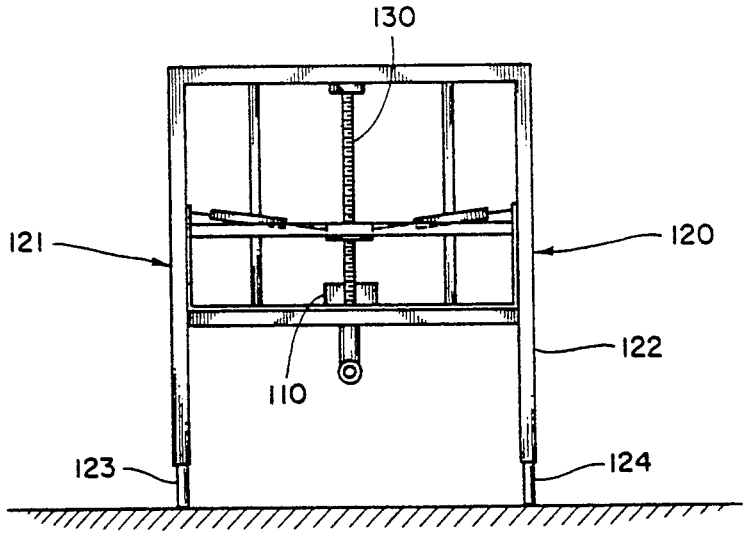
FIG. 7 is rear view of the hospital bed illustrated in FIG. 5.

A modified power module 110 is illustrated in FIGS. 6 to 9 in connection with a hospital type articulated bed 112. Bed 112 includes a head assembly 115 consisting of a rectangular carriage 116 vertically slidable on posts 117, and a foot assembly 120 including an upper rectangular carriage 121 slidable on stationary tubular posts 122. The foot assembly 120 is illustrated FIG. 7 it should be understood head assembly 115 is generally similar although somewhat larger. Bed assembly 112 includes a rigid rectangular frame 126 that moves vertically upwardly and downwardly as a unit with power module 110 by means of forward and rear cross-frames 127 and 128 that are threadedly carried by vertical screws 130. Screws 130 are rotated by universal drive shafts 132 and 133 by an additional motor 135 seen in FIGS. 6 and 8 carried by the rear of drive module housing 137. As motor 135 rotates reversely under the control of control assembly 140 also carried by forward end 141 of housing 137, utilizing a third switch 143, a drive shafts 132 and 133 rotate screws 130 raising and lowering frame 126 as desired along with power module 110. Referring to FIG. 6, the power module 110 is supported on a mattress support assembly 145 similar to support 12 illustrated in connection FIGS. 1 to 2 except a heavier duty version to accommodate the hospital environment. In any event mattress support assembly 145 includes a head panel 150, central panel 151, side panel 152 and leg panel 153. The rear end of panel 153 is linked to frame 126 by pivotal bars 155.

Figure 8:
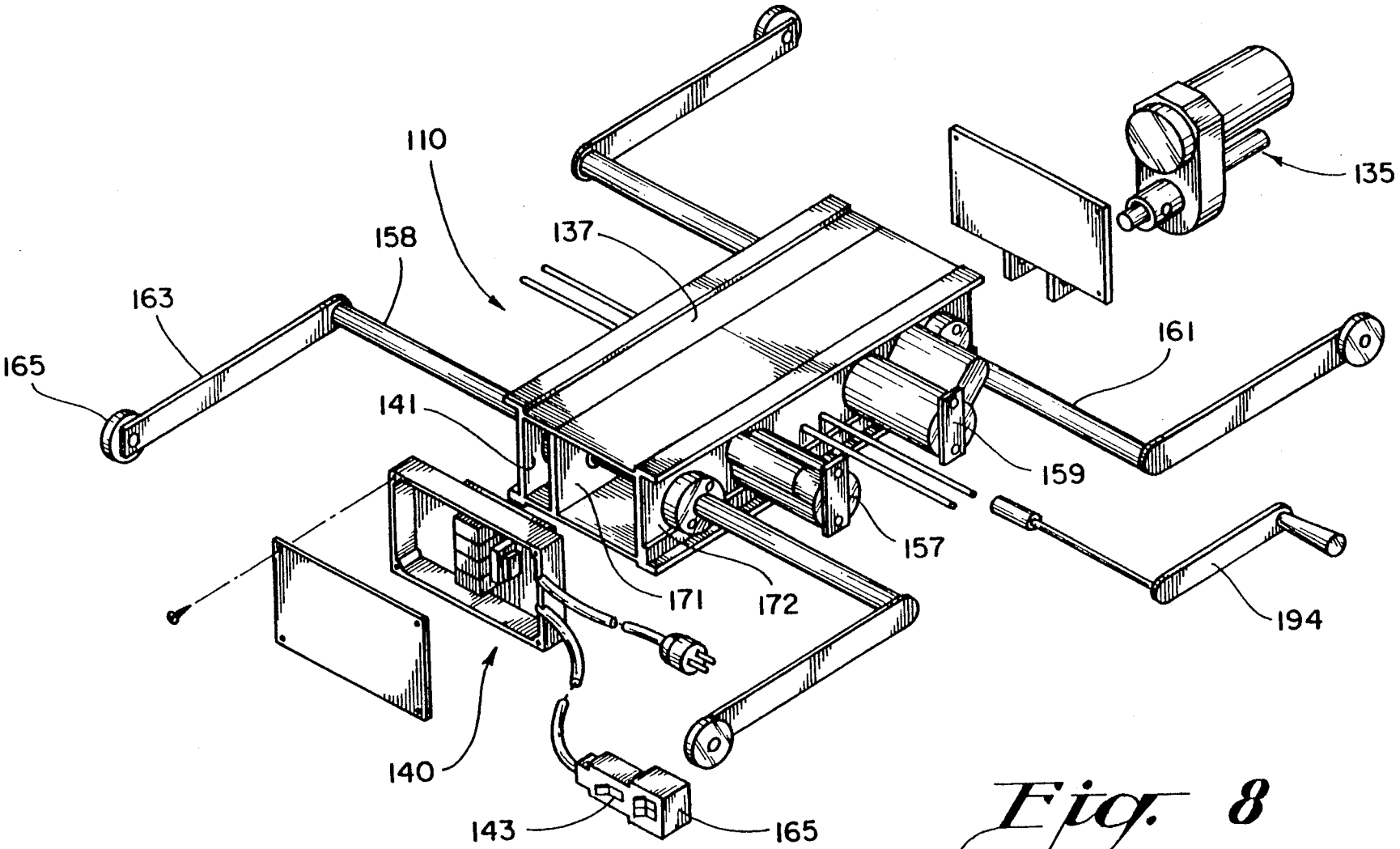
FIG. 8 is a perspective view of a further alternative of the power module similar to FIG. 3 except adapted for manual override.
Figure 9:
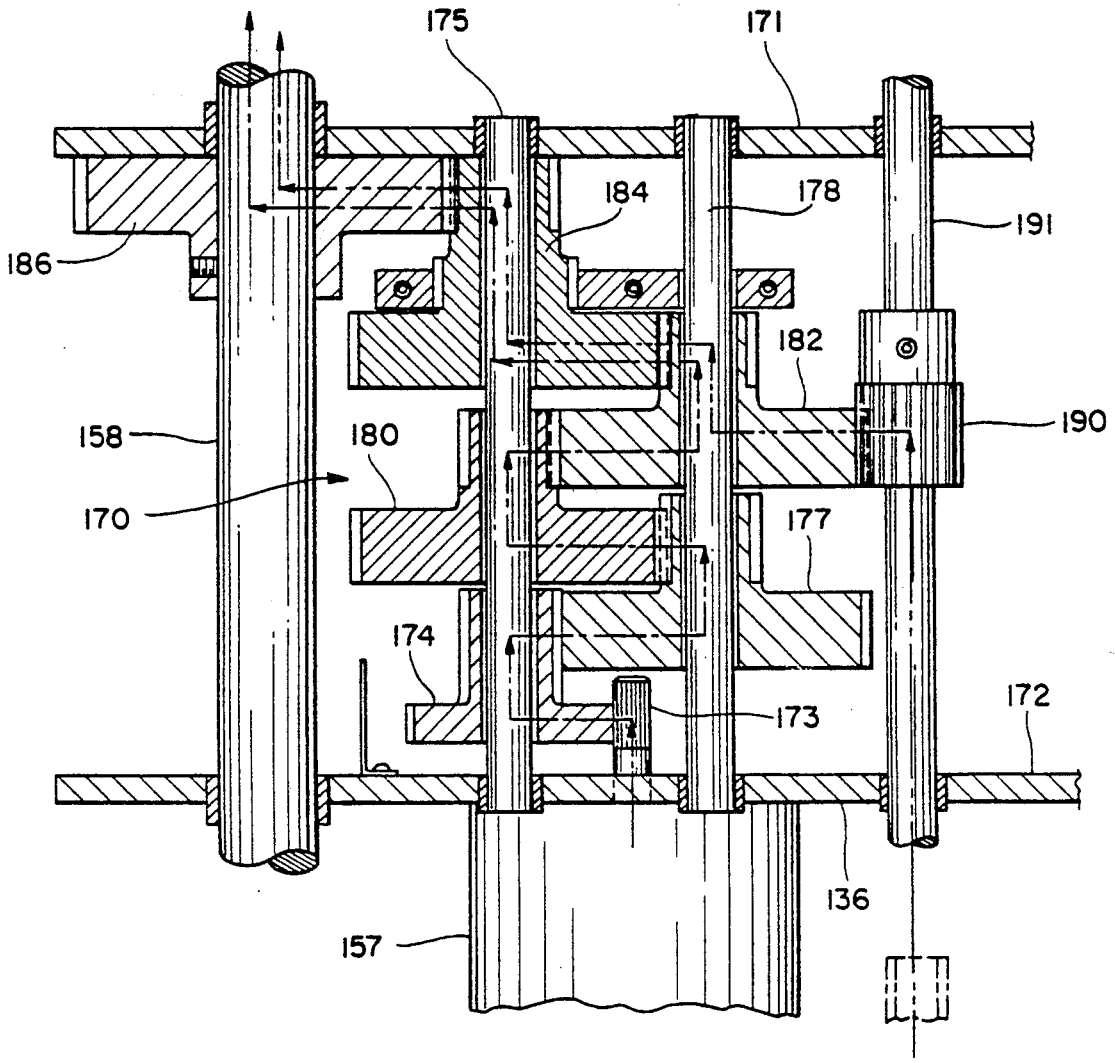
FIG. 9 is top fragmentary view of the gearing in the power module illustrated in FIG. 8 showing the manual override gearing.

As seen in FIGS. 8 and 9, the power module 137 includes a first electric motor 157 adapted to pivot the forward rocker shaft 158 and a rear electric motor 159 adapted to pivot rear rocker shaft 161. Both rocker shafts 158 and 161 carry rocker arms 163 with nylon rollers 165 at their distal ends in the same way as described above with respect to the in FIGS. 1 and 2 embodiment. Motors 157 and 159 are reversely controlled by remote control 165 associated with control 140.

Housing 110 is somewhat wider than housing 41 in FIG. 3 to accommodate the parallel pinion reducing gear assembly 170 shown mounted between housing side walls 171 and 172. Gearing 170 is the same for both motors 157 and 159 and is shown in connection with motor 157 in FIG. 9, which as described above pivots rocker shaft 158. Gearing 170 is essentially a five stage reduction gearing including motor output shaft 173 engaging reducing pinion pair 174 on idler shaft 175 interengaging a reducing pinion pair 177 rotatably mounted on idler shaft 178 in turn engaging reducing pinion 180 on idler shaft 175, that engages reducing pinion gear 182 on idler shaft 178 which engages reducing pinion pair 184 on idler shaft 175 finally engaging enlarged pinion gear 186 fixedly carried by rocker shaft 158. A manual override gear 190 fixed to shaft 191, also journalled in housing plates 171 and 172, engages intermediate reducing pinion pair 182 to drive the rocker shaft 158 through pinion pairs 184 and gear 186 so that the head and the foot or leg portions can be manual raised and lowered with manual cranks 194 illustrated in FIG. 8.

In other respects the power module 110 is similar to that described above in connection with FIGS. 1 to 3.

What is claimed is:

1. A unitary power module for an articulated mattress support adapted to fit into a standard bed frame having recesses adapted to receive a mattress, comprising: housing means, motor means supported on the housing means, gearing in the housing means adapted to be driven by the motor means, an output rocker shaft mounted and soley supported in the housing means driven by the gearing, said rocker shaft extending laterally outwardly from the housing means outside the housing means, arm means fixed to the rocker shaft having a distal end with slide means adapted to engage a movable member in the mattress support to swing the movable member up and down, and control means to reversely operate the motor to raise and lower the movable member in the mattress support, means on the housing means for completely supporting the power module on the bed, said power module being unsupported on the rocker shaft, whereby the power module can be installed on and removed as a unit from the bed without disassembling the frame.

2. A unitary power module for an articulated mattress support as defined in claim 1, wherein the mattress support includes planar panels having a width substantially equal to the width of the standard bed frame, at least one of the panels being pivotally connected to an adjacent panel to swing up and down, said power module housing means having means thereon adapted to connect it to the adjacent panel of the mattress support, said arm means engageable with the pivotally connected panel that swings up and down.

3. A unitary power module for an articulated mattress support as defined in claim 1, wherein said housing means is elongated and has two rocker shafts each mounted transversely to the housing at opposite ends thereof, said arms means inlcudes at least one arm connected to each rocker shaft adapted to pivot one movable member, said motor means including two separate electric motors mounted transversely in the housing means.

4. A unitary power module for an articulated mattress support as defined in claim 3, wherein the gearing includes a worm wheel and interengaging worm gear assembly between each motor and each rocker shaft.

5. A unitary power module for an articulated mattress support as defined in claim 3, wherein the gearing includes a parallel shaft pinion reducing gearing assembly between each motor and each rocker shaft.

6. A unitary power module for an articulated mattress support as defined in claim 5, including manually operable override gearing in the reducing gearing assembly to manually pivot the movable members in the mattress support.

7. A unitary power module for an articulated mattress support as defined in claim 1, including an additional motor connected to the power module for vertically lifting the entire mattress support.

8. A conventional bed frame, mattress support and unitary power module combination wherein the mattress support may be placed on the conventional bed frame easily and the power module is supported soley on the mattress support, comprising: a standard bed frame having spaced parallel side frame members each including a horizontal wall and an upwardly projecting vertical wall therefrom, a mattress support including a plurality of planar members having a width sized to fit in the standard frame resting on top of the horizontal walls of the frame members, at least one of the planar members in the mattress support being pivotally mounted to an adjacent stationary planar member for swinging movement up and down, said power module including an elongated housing fixed to and supported underneath the adjacent stationary planar member, said stationing planar member providing the sole support for the power module, at least one rocker shaft rotatably mounted in and soley supported by the housing without any outboard bearings, said rocker shaft extending laterally outwardly from the housing, a pair of pivot arms outside the housing means fixed to the rocker shaft having slide means on the distal ends thereof adapted to slidably engage the pivotal planar member, motor means in the housing, gearing interconnecting the motor means to the rocker shaft, and control means for reversely driving the motor means to raise and lower the pivotal mattress planar member, said power module being unsupported on the rocker shaft, whereby the power module can be installed on and removed as a unit from the bed without disassembling the frame.

9. A conventional bed frame, mattress support and a unitary power module as defined in claim 8, wherein said housing means is elongated and has two rocker shafts each mounted transversely to the housing at opposite ends thereof, said arms means include at least one arm connected to each rocker shaft adapted to pivot one movable member, said motor means including two separate electric motors mounted transversely in the housing means.

10. A conventional bed frame, mattress support and unitary power module as defined in claim 9, wherein the gearing includes worm wheel and interengaging worm gear assembly between each motor and each rocker shaft.

11. A conventional bed frame, mattress support and unitary power module as defined in claim 9, wherein the gearing includes a parallel shaft pinion reducing gearing assembly between each motor and each rocker shaft.

12. A conventional bed frame, mattress support and unitary power module as defined in claim 11 including manually operable override gearing in the reducing gearing assembly to manually pivot the movable members in the mattress support.

13. A unitary power module for an articulating mattress support, that is unitary and may be manufactured and transported independently of other assemblies, comprising: an elongated housing, means for attaching the housing to a mattress support and providing the sole means for supporting the power module, first and second motors mounted transversely in the housing, parallel spaced rocker shafts mounted transversely in opposite ends of the housing, said rocker shafts being rotatably mounted in and soley supported by the housing, said rocker shafts extending laterally outwardly from the housing, gearing connecting each motor to drive the rocker shafts, spaced parallel rocker arms fixed to the ends of each of the rocker shafts outside said housing means, roller means on the distal ends of all of the rocker arms adapted to engage and roll on and pivot the mattress support, and control means to reversely drive each motor to raise and lower the mattress support as desired, said power module being unsupported on the rocker shafts, whereby the power module can be installed on and removed as a unit from the bed without disassembling the frame.

* * * * *